United States Patent [19]

Jaworski et al.

[11] Patent Number: 4,459,776

[45] Date of Patent: Jul. 17, 1984

[54] MOTOR DRIVEN WHEELED TOY WITH FLOATING DRIVEN AXLE

[75] Inventors: Eugene Jaworski, Park Ridge; Jeffrey D. Breslow, Highland Park; Tom K. Sakoda, Chicago; Harry Disko, South Barrington, all of Ill.

[73] Assignee: Marvin Glass & Associates, Chicago, Ill.

[21] Appl. No.: 436,650

[22] Filed: Oct. 25, 1982

[51] Int. Cl.[3] ..... A63H 17/00

[52] U.S. Cl. ..... 446/462; 446/457

[58] Field of Search ..... 46/201, 221, 251, 202, 46/206, 209, 211, 219, 217; 180/22, 247

[56] References Cited

U.S. PATENT DOCUMENTS

| | | | |
|---|---|---|---|
| 1,471,295 | 10/1923 | Thorp | 180/22 X |
| 2,267,562 | 12/1941 | Higgins | 180/22 X |
| 2,996,840 | 8/1961 | Goss | 46/206 X |
| 3,506,079 | 4/1970 | Madler et al. | 180/22 |
| 3,517,458 | 6/1970 | Sato | 46/251 |

FOREIGN PATENT DOCUMENTS

| | | | |
|---|---|---|---|
| 884020 | 7/1953 | Fed. Rep. of Germany | 46/221 |
| 1062595 | 7/1959 | Fed. Rep. of Germany | 46/206 |

*Primary Examiner*—Mickey Yu

*Attorney, Agent, or Firm*—John S. Pacocha

[57] ABSTRACT

A motor driven wheeled toy is provided with a driven axle that swivels in a vertical plane transverse to the direction of movement of the vehicle. More than one of such driven axles, each swiveling independent of the other, may also be provided. The vehicle motor drives an elongated shaft that is transverse to the axle. Respective gears are carried by and rotate with the shaft and the axle for transmitting power between the shaft and the axle. A connector having substantially right angle plates is carried by the shaft for rotation around the axis of the shaft. The shaft fits through a bearing aperture in the end plate of the connector. The axle extends through an opening in the transverse side plate of the connector which permits the axle to rotate with respect to the connector and to swivel together with the connector around the axis of the shaft. The wheels mounted on the ends of the axles for rotation with the axles are of a soft resilient material and have a large diameter to permit movement of the vehicle over rough surfaces and obstacles.

20 Claims, 4 Drawing Figures

MOTOR DRIVEN WHEELED TOY WITH FLOATING DRIVEN AXLE

BACKGROUND OF THE INVENTION

1. Field of the Invention

This invention relates generally to motor driven toy vehicles and more particularly to the drive assembly.

2. Background Art

A number of motor driven toy vehicles simulating real-life counterparts have been designated for traveling over rough surfaces and obstacles. Most of such prior art toy vehicles have been of the "tank type" in which the ground engaging element comprises an endless belt with external threads or lugs which grip the surface or obstacle. One such type of toy is shown in U.S. Pat. No. 3,849,931. In addition to the tank type vehicles whose real-life counterparts are primarily found in military and construction uses, recreational vehicles, sometimes referred to as all terrain vehicles or "ATVs" having three sets of axles, have become popular. Such a toy ATV is shown in U.S. Pat. No. 3,712,397 having only the middle axle driven with the wheels on that axle individually locked to effect turning of the vehicle about the locked wheel. The ability of such prior art toys to move over rough surfaces and climb over obstacles is limited by the fixed relationship among the driven members and the vehicle chassis.

SUMMARY OF THE INVENTION

The present invention is concerned with providing a motor driven toy vehicle whose driven elements are free to move vertically with respect to each other in order to facilitate the ability of the toy to climb over a variety of obstacles. These and other objects and advantages of the invention are achieved by connecting the output of the motor carried by the toy vehicle to an elongated drive shaft which itself carries transverse axles. Each of the axles is mounted for rotating about its own axis, swiveling with respect to the axis of the shaft and for power transmission by means of a connector having right angle bearing plates.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
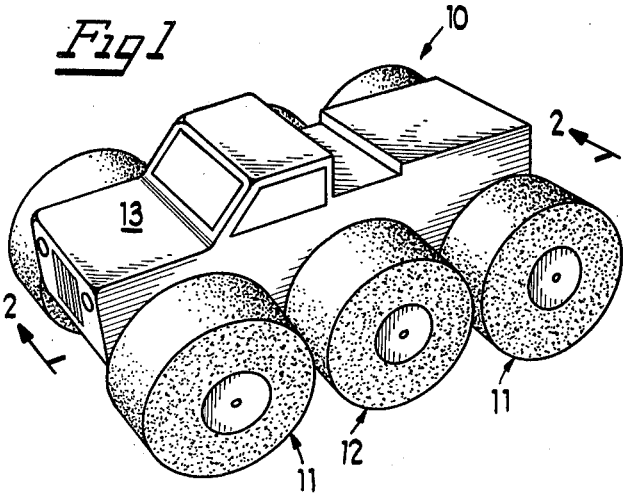
FIG. 1 is a perspective view of a toy vehicle embodying the invention.

Referring now to the drawings in which like parts are designated by like reference numerals throughout the several views, there is shown in FIG. 1 in all-terrain type vehicle 10 having two independent end axle and wheel assemblies 11 and a middle independent axle and wheel assembly 12. Each of the axle and wheel assemblies 11 and 12 are identical and each is driven, but the mounting is different.

Vehicle 10 is provided with an integral chassis and body 13, although the chassis and body could be separate connectable components. A central support member 14 is provided to strengthen the chassis in the area of the power source. An on/off switch 15 having an exposed button 16 is connected to a battery 17 and a small electric motor 18 by conventional wiring (not shown) and carried by the body 13. Motor 18 is provided with an output shaft 19 and pinion 20. Intermediate gear 22 meshes with the pinion 20 and is secured for rotation on shaft 23 along with coaxial pinion gear 24. The shaft 23 is journaled for rotation in a supporting arm 26 extending from support member 14.

A drive shaft 30 is journaled for rotation, at each end of the chassis 13, in inwardly extending journal bosses 33 that are formed as an integral part of the chassis. In addition, the shaft 30 is also supported for rotation intermediate its ends by the opposed transverse walls of the support member 14, each of which is provided with a bearing bore 34. Secured to the shaft 30 for rotation with the shaft are a gear 36 and a coaxial worm 38. Additional worms 40 are also secured for rotation with the shaft, each at a spaced interval away from a respective end of the worm 38.

Each of the wheel and axle assemblies 11 and 12 comprises an axle 42 with a coaxial hub 44 and wheel 45 subassembly secured to an end of the axle 42 for rotation with the axle. Intermediate the ends of the axle 42 a worm gear 48 is secured to the axle for rotation with the axle 42. The middle axle and wheel assembly is carried by the chassis 13. The axle 42 of the middle assembly 12 is journaled for rotation in aligned openings 50 in the opposed side walls of the chassis 13 and support member 14 such that the worm gear 48 is in driving engagement with the worm 38 that is secured to the shaft 30.

Figure 4:
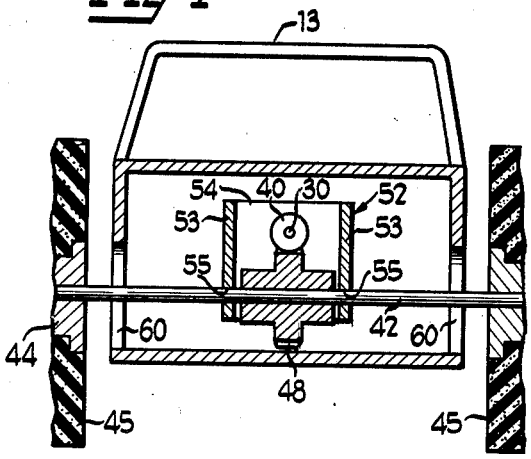
FIG. 4 is a partial sectional view taken substantially along line 4—4 of FIG. 3.
Figure 2:
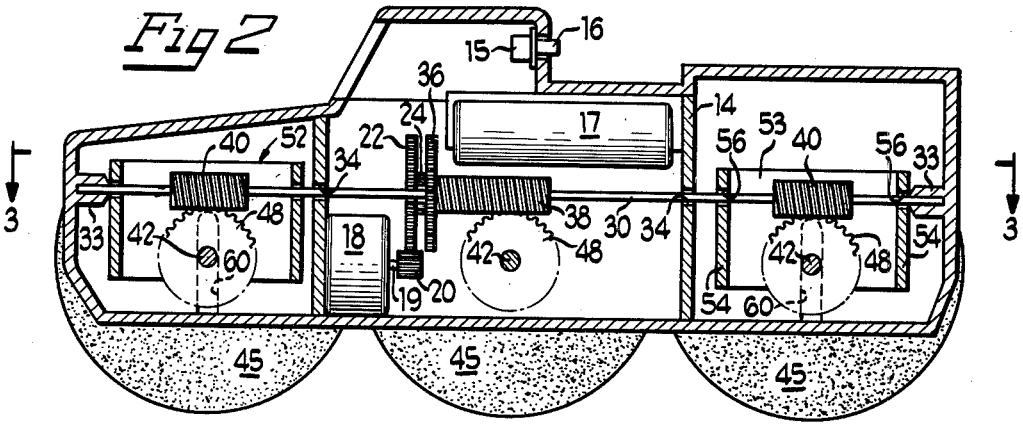
FIG. 2 is an enlarged cross-sectional view taken substantially along line 2—2 of FIG. 1.
Figure 3:
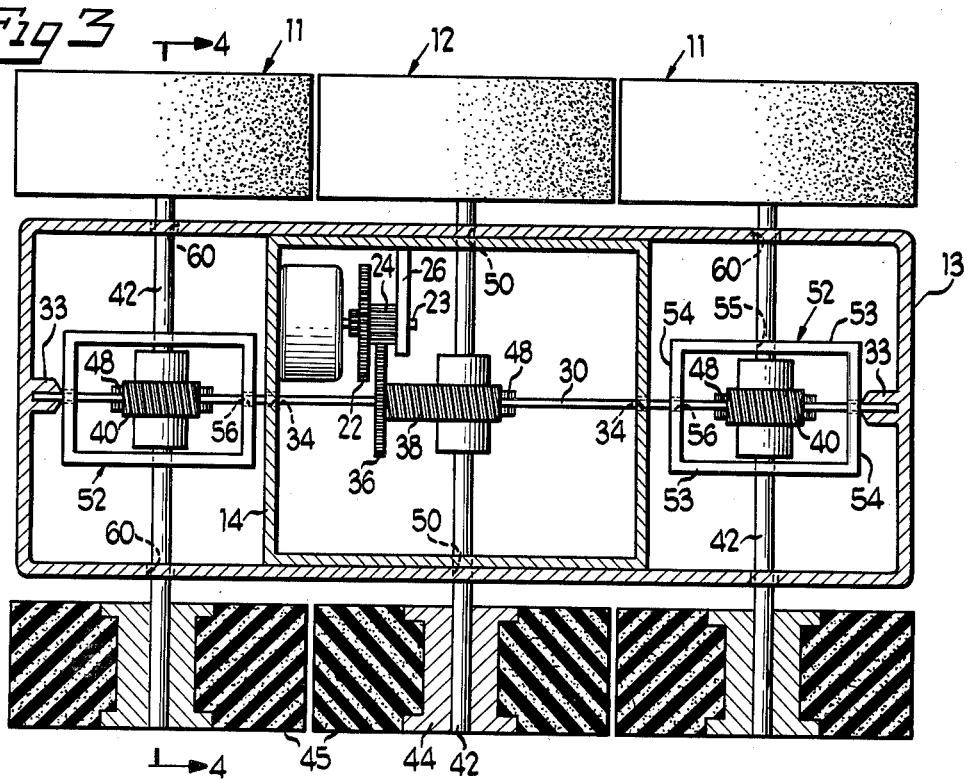
FIG. 3 is a sectional view taken substantially along line 3—3 of FIG. 2.

The end wheel and axle assemblies 11 are identically mounted to swivel in power transmitting relationship with respect to the axis of the shaft 30. Connector 52 is a substantially rectangular box with opposed side plates 53 and substantially parallel opposed end plates 54 that are transverse to the side plates 53. The axle 42 is received in and rotates within aligned openings 55 in each of the side walls 53. Worm gear 48 is contained between the spaced substantially parallel walls 53. The opposed end walls 54 are provided with apertures 56 that permit the box 52 to rotate or swivel around the axis of the shaft 30. Again, the worm gear 48 is within the space between the opposed parallel end walls 54. As shown in FIGS. 2, 3, and 4, the worm 40 carried by the shaft 30 is also contained within the box 52 and drivingly engages the worm gear 48. It will be appreciated from the foregoing description and the drawing figures that as the box 52 carrying the wheel and axle assembly 11 rotates around the axis of the shaft 30 the worm gear 48 remains in driving engagement with the worm 40 throughout the rotation. Although the mounting means for the axle with respect to the drive shaft of this invention permits rotation of the axle a full 360 degrees around the drive shaft while maintaining driving engagement, the rotation of the wheel and axle assembly 11 may be limited by design factors inherent in the selected style for the chassis and body 13. As is best shown in FIG. 2, substantially vertically extending slots 60 provided in the body of the vehicle permit movement of the axle 42 on each of the end assemblies in a vertical plane but limit that movement to less than full rotation around shaft 30.

The middle wheel and axle assembly 12 could be mounted for rotation with respect to the drive shaft 30 in the manner similar to the end axle and wheel assemblies 11. However, as mounted in the described preferred embodiment, each of the axles is independently rotatable with respect to the others permitting the toy vehicle 10 to climb over a variety of severely irregular surfaces and obstacles.

To facilitate the maneuverability of the vehicle 10, the wheels 45 are preferably made of a soft, easily deformable elastic material such as foam rubber. In addition, the diameter of the wheels should be sufficiently great to provide ground clearance as the wheels and axles swivel and the vehicle 10 climbs over various surfaces. In this connection it has been found that a diameter at least twice as great as the worm gear 48 should be employed.

While there has been illustrated and described a particular embodiment of the present invention, it will be apparent that various changes and modifications will occur to those skilled in the art. For example, other gear arrangements for effecting a transverse power transmission such as a pinion on the shaft engaging a crown gear on the axle could be used. In addition, depending on the design of the vehicle and the materials selected, it might not be necessary to use an enclosed connector such as the box 52 and a three-sided or U-shaped journal connector or even an L-shaped connector may suffice. It is intended in the appended claims to cover all such changes and modifications as fall within the true spirit and scope of the present invention.

What is claimed as new and desired to be secured by Letters Patent is:

1. A motor driven toy with ground engaging wheels comprising:

a chassis;

a rotatable drive shaft with an axis carried by the chassis;

a power connection connectable to a motor and the shaft to rotate the shaft;

a first axle with an axis and ends disposed transverse to the shaft;

a wheel mounted on each end of the first axle for movement with the axle;

a first connector means carried by the shaft and carrying the first axle for rotation around the first axle axis and to swivel about the axis of the shaft;

power transmission means between the shaft and the first axle that remains engaged while the first axle swivels about the shaft;

a second axle with an axis and ends disposed transverse to the shaft;

a wheel mounted on each end of the second axle for movement with the second axle;

a second connector means carried by the shaft and carrying the second axle for rotation around the second axle axis and to swivel about the axis of the shaft; and power transmission means between the shaft and the second axle that remains engaged while the second axle swivels about the shaft.

2. The motor driven toy of claim 1 in which the power transmission means includes:

first gear means mounted on the shaft for rotation with the shaft; and second gear means mounted on the axle for rotation with the axle.

3. The motor driven toy of claim 2 in which the first gear means is a worm and the second gear means is a worm gear.

4. The motor driven toy of claim 2 in which the first gear means is a pinion and the second gear means is a crown gear.

5. The motor driven toy of claim 2 in which the diameter of the wheels is at least twice the diameter of the second gear means.

6. The motor driven toy of claim 1 including clearance means on the chassis to permit the axle and wheels to swivel about the shaft.

7. The motor driven toy of claim 1 in which the wheels are formed of a soft resilient material.

8. The motor driven toy of claim 1 in which the connector means has:

substantially transverse first and second portions;

an aperture in the first portion receiving the shaft and permitting rotation of the connector means with respect to the shaft; and an opening in the second portion rotatingly receiving and carrying the axle.

9. The motor driven toy of claim 8 in which the second portion comprises spaced substantially parallel side plates and the opening is in each of the side plates.

10. The motor driven toy of claim 9 in which the power transmission means is contained between the spaced side plates.

11. The motor driven toy of claim 8 in which the first portion comprises spaced substantially parallel end plates, the aperture being in each of the end plates, and the second portion comprises spaced substantially parallel side plates, the opening being in each of the side plates.

12. A motor driven toy with ground engaging wheels comprising:

a chassis;

a rotatable drive shaft with an axis carried by the chassis;

a power connection connectable to a motor and the shaft to rotate the shaft;

an axle with an axis and ends disposed transverse to the shaft;

a wheel mounted on each end of the axle for movement with the axle;

connector means carried by the shaft and carrying the axle for rotation around the axle axis and to swivel about the axis of the shaft;

the connector means having substantially transverse first and second portions;

the first portion including spaced substantially parallel end plates;

an aperture in each of the end plates receiving the shaft and permitting rotation of the connector means with respect to the shaft;

an opening in the second portion rotatingly receiving and carrying the axle; and power transmission means between the shaft and the axle that remains engaged while the axle swivels about the shaft.

13. The motor driven toy of claim 12 in which the second portion comprises spaced substantially parallel side plates and the opening is in each of the side plates.

14. The motor driven toy of claim 13 in which the power transmission means is contained in the space defined by the spaced end plates and the spaced side plates.

15. The motor driven toy of claim 12 in which the power transmission means is contained between the spaced end plates.

16. A motor driven toy with ground engaging wheels comprising:

a chassis;

motor means mounted on the chassis;

a single rotatable drive shaft with an axis carried by the chassis;

a power connection between the motor means and the shaft to rotate the shaft;

more than one axle each having an axis and ends;

each of the axles being disposed in parallel planes with respect to each other;

each of the axles being disposed transverse to the shaft;

at least two connector means carried by the shaft for rotation around the shaft at spaced intervals along the shaft;

each of the connector means mounting one of at least two of the axles for rotation about the axle axis; and power transmission means between the shaft and each of the at least two axles, which power transmission means remain engaged while the connectors rotate around the shaft.

17. The motor driven toy of claim 16 in which the connector means has:

substantially transverse first and second portions;

an aperture in the first portion receiving the shaft and rotatably mounting the connector means on the shaft; and an opening in the second portion rotatingly receiving and carrying the axle.

18. The motor driven toy of claim 17 in which the first portion comprises spaced substantially parallel end plates, the aperture being in each of the end plates, and the second portion comprises spaced substantially parallel side plates, the opening being in each of the side plates.

19. The motor driven toy of claim 18 in which the power transmission means is contained between the spaced end plates and between the spaced side plates.

20. The motor driven toy of claim 19 in which the power transmission means includes:

a worm mounted on the shaft for rotation with the shaft; and a worm gear mounted on the axle for rotation with the axle.

* * * * *

UNITED STATES PATENT AND TRADEMARK OFFICE

CERTIFICATE OF CORRECTION

PATENT NO. : 4,459,776

DATED : July 17, 1984

INVENTOR(S) : Eugene Jaworski et al.

It is certified that error appears in the above-identified patent and that said Letters Patent is hereby corrected as shown below:

Column 1, Background Art, line 2 change "designated" to --designed--.

Signed and Sealed this

*Twenty-fifth* Day of *December 1984*

[SEAL]

*Attest:*

GERALD J. MOSSINGHOFF

*Attesting Officer*

*Commissioner of Patents and Trademarks*